US005169060A

United States Patent [19]

Tighe et al.

[11] Patent Number: 5,169,060

[45] Date of Patent: Dec. 8, 1992

[54] DIRECT AND RETURN MAILING UNIT

[75] Inventors: John F. Tighe, Rabbit Hill, Drawer 1086, Truro, Mass. 02666; Harold Pezzner, Wilmington, Del.

[73] Assignee: John F. Tighe, Truro, Mass.

[21] Appl. No.: 692,668

[22] Filed: Apr. 29, 1991

[51] Int. Cl.[5] ..... B65D 27/06

[52] U.S. Cl. ..... 229/301; 229/70; 229/92.1; 229/305

[58] Field of Search ..... 229/70, 73, 92.1, 92.3, 229/92.7, 300, 301, 305

[56] References Cited

U.S. PATENT DOCUMENTS

| | | | |
|---|---|---|---|
| 203,409 | 5/1878 | Brooks . | |
| 1,089,486 | 3/1914 | Levine | 229/305 |
| 1,995,183 | 4/1935 | Kovnat . | |
| 2,270,455 | 1/1942 | Lichter . | |
| 2,759,658 | 8/1956 | Sawdon | 229/305 |
| 2,872,100 | 2/1959 | Coffin . | |
| 2,884,184 | 4/1959 | Turan . | |
| 2,910,222 | 10/1959 | Bermingham . | |
| 3,018,033 | 1/1962 | Henry . | |
| 3,184,150 | 5/1965 | Hubbard | 229/305 |
| 3,360,184 | 12/1967 | Greason . | |
| 3,652,007 | 3/1972 | MacDougall | 229/73 |
| 3,718,277 | 2/1973 | Volkert | 229/92.1 X |
| 3,858,792 | 1/1975 | Volkert | 229/92.3 X |
| 3,977,597 | 8/1976 | Wise . | |
| 3,995,808 | 12/1976 | Kehoe . | |
| 4,011,985 | 3/1977 | Simson . | |
| 4,044,942 | 8/1977 | Sherwood . | |
| 4,102,489 | 7/1978 | Lucas . | |
| 4,305,506 | 12/1981 | Greenwald | 229/73 X |
| 4,706,878 | 11/1987 | Lubotta et al. | 229/73 |
| 4,730,767 | 3/1988 | Gendron | 229/305 |
| 4,754,915 | 7/1988 | Steidinger | 229/73 X |
| 4,778,101 | 10/1988 | Paquin | 229/73 |
| 4,801,076 | 1/1989 | Schoenleber et al. | 229/927 |
| 4,865,247 | 9/1989 | Grabner | 229/92.1 |

*Primary Examiner*—Stephen Marcus
*Assistant Examiner*—Jes F. Pascua
*Attorney, Agent, or Firm*—Connolly & Hutz

[57] ABSTRACT

A direct and return mailing unit comprises a unitary sheet having at least three panels. Two of the panels are end panels and there is at least one intermediate panel. A fold line connects each set of adjacent panels together. One of the end panels is of multi-layer construction to form a reply envelope. One of the intermediate panels has original addressee information and postage on its front face. The reply envelope end panel has return addressee information and postage on one of its faces. All of the panels are folded against each other to provide a folded assembly of the size of the intermediate panel having the original addressee information invisible, while the return addressee information is concealed.

13 Claims, 7 Drawing Sheets

DIRECT AND RETURN MAILING UNIT

BACKGROUND OF THE INVENTION

In direct advertising solicitation and the like, it is customary to mail to the original addressee information regarding certain products or services of the sender. In such direct mailing it is also desirable if some means could be provided so that the original addressee could readily respond by return mail. The most common means used for this purpose is to include an outer envelope containing information regarding, for example, products or services and then to also include a reply postcard or a reply envelope within the outer envelope so that the original addressee could conveniently respond by return mail.

It would be desirable if this form of direct mailing could be practiced in a way so as to minimize costs and efforts by the original addressee in returning a response. It would also be desirable to provide a practice which facilitates as much as possible the original addressee making such response.

SUMMARY OF INVENTION

An object of this invention is to provide a direct and return mailing unit which meets the above needs.

A further object of this invention is to provide such a direct and return mailing unit which contains the least amount of separate components while still fulfilling the function of being mailed to the original addressee and permitting that addressee to conveniently respond by return mail.

A still further object of this invention is to provide such a direct and return mailing unit which could contain personalized information directed to the specific original addressee.

In accordance with this invention, the direct and return mailing unit is in the form of a unitary sheet having at least three panels which constitute two end panels and at least one intermediate panel. The panels are connected to each other by fold lines. One of the end panels is of double thickness with respect to its intermediate panels and includes return addressee information and postage. One of the intermediate panels is provided with the original addressee information and postage on its front face. The panels are originally folded in such a manner that a folded assembly results of the size of the intermediate panel having the original addressee information with that information being visible while the return addressee information is concealed.

In the practice of this invention, the double thickness panel is in the form of a return envelope, preferably having a separate flap which forms a further layer of thickness. If the panels are of sufficient thickness the opposite end panel could be a reply postcard.

Any combination of reply envelopes and reply postcards may be used. For example, each end panel may be in the form of a reply envelope. Alternatively, one end panel may be a reply envelope, while the other end panel is a reply postcard. If desired only one reply envelope with no reply postcard may be used.

THE DRAWINGS

DETAILED DESCRIPTION

The present invention is directed to the provision of a mailing unit which may be conveniently sent to an original addressee to contain information relating to products or services or the like and which incorporate some form of a reply means to facilitate the original addressee conveniently responding to the mail solicitation. The invention may be practiced in various manners. In general, the invention includes the provision of a sheet having at least three panels with one of the end panels serving as a means for responding by return mail and with one of the intermediate panels containing the original addressee information. The panels are folded to comprise a folded unit which may be mailed in its folded condition without the use of an outer envelope. The invention may be practiced with various types of reply forms. For example, the reply form could be an envelope or a reply postcard. Multiple reply forms could be provided on the unit at each end thereof in various combinations including a reply envelope at each end, at least one reply postcard at one end or a combination of envelopes and postcards.

Figure 1:
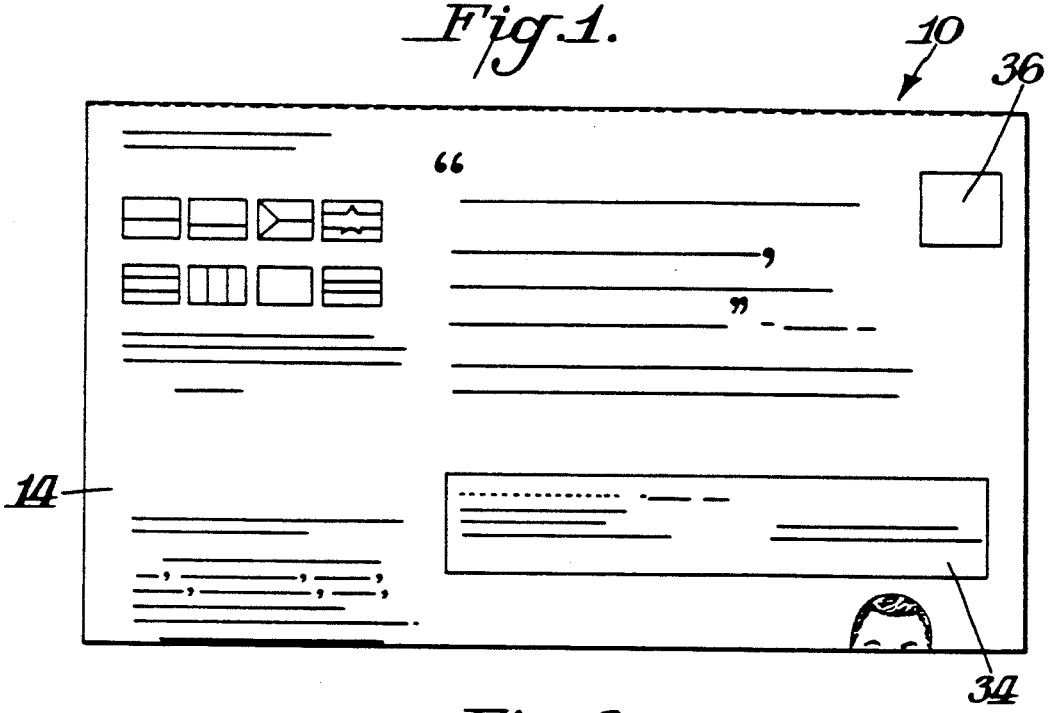
FIG. 1 is a top plan view of a folded direct and return mailing unit in accordance with this invention.
Figure 2:
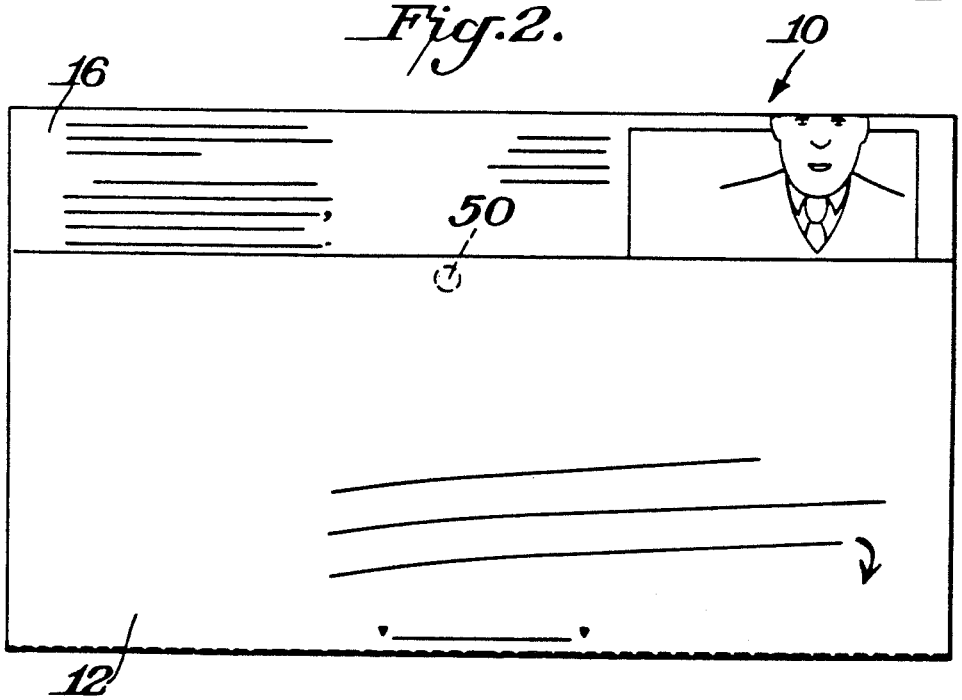
FIG. 2 is a bottom plan view of the mailing unit shown in FIG. 1.
Figure 3:
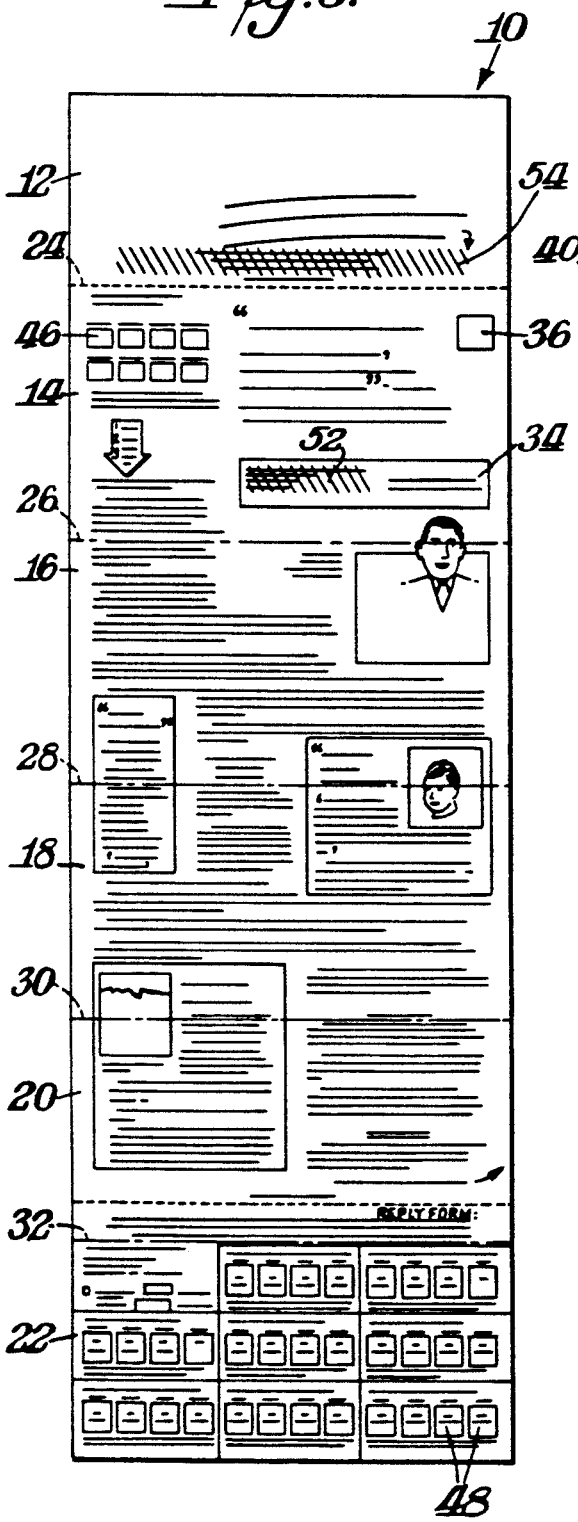
FIG. 3 is a top plan view showing the mailing unit of FIGS. 1–2 in its unfolded state on the front side thereof.
Figure 4:
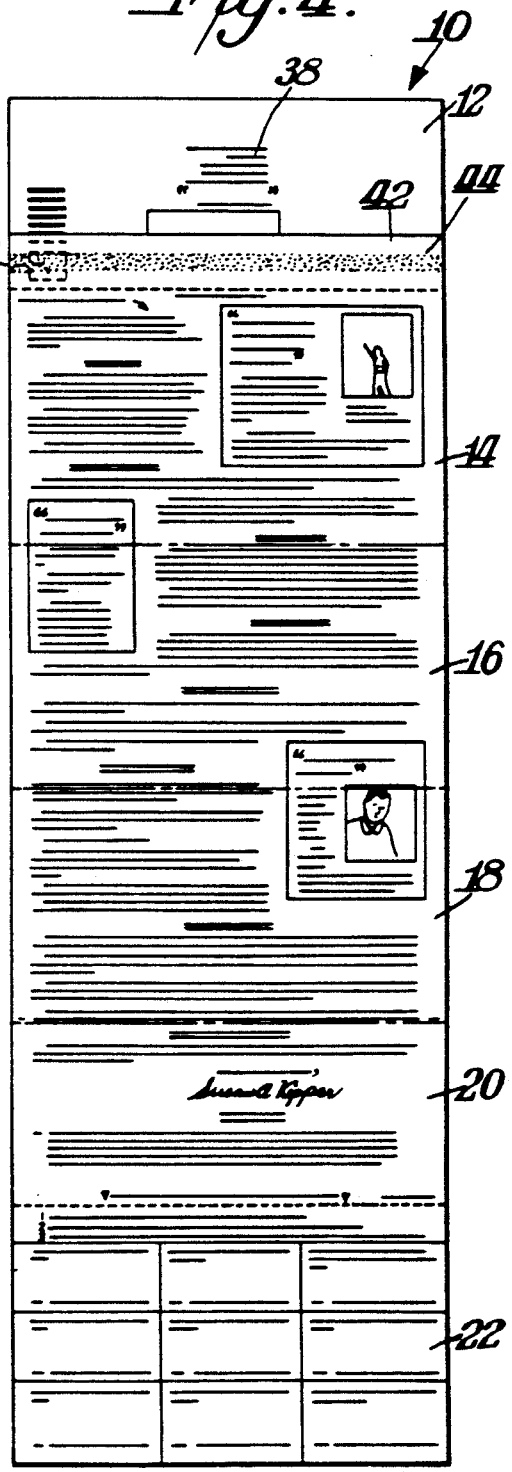
FIG. 4 is a view similar to FIG. 3 showing the backside thereof.
Figure 5:
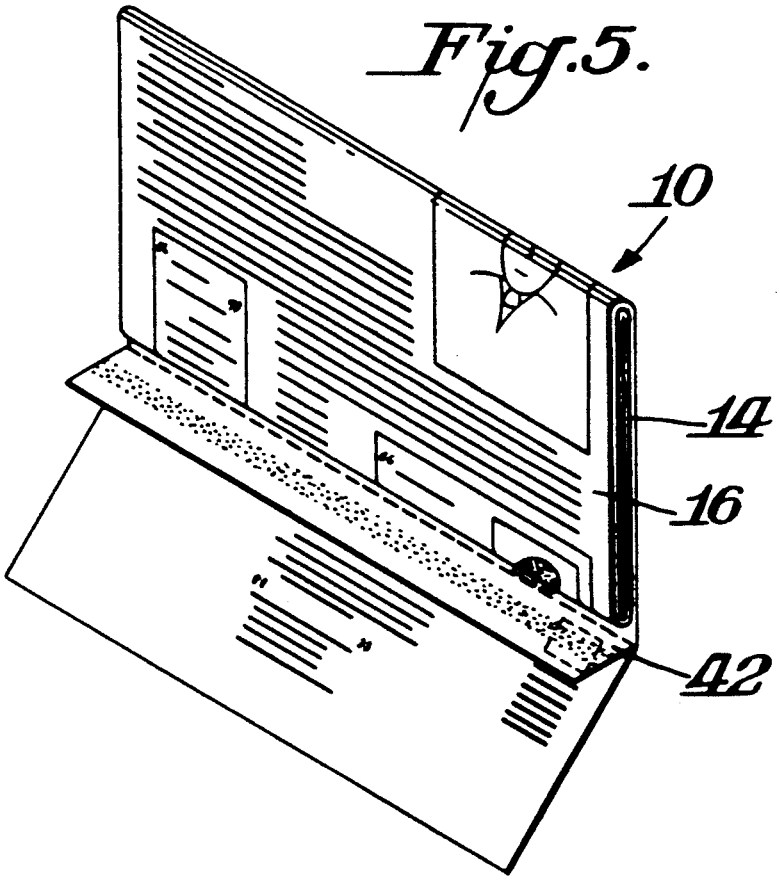
FIG. 5 is a perspective view showing the unit of FIGS. 1–4 in its partially folded condition.

FIGS. 1–6 illustrate a mailing unit 10 in accordance with one practice of this invention. As best shown in FIGS. 3–4, the mailing unit 10 is in the form of a sheet of, for example, conventional mailing material, such as paper which is divided into a number of individual panels 12, 14, 16, 18, 20, 22. Adjacent panels are separated by fold lines 24, 26, 28, 30, 32. It is to be understood that the illustrated number of panels is merely for exemplary purposes and the invention may be practiced with a larger or lesser number of panels.

Panels 12 and 22 are the end panels and their fold lines 24, 32 are weakened such as being perforated to permit ready detachment from the remainder of the sheet. FIG. 3 illustrates the front side of the sheet while the back side is illustrated in FIG. 4. As shown in FIG. 3, intermediate panel 14 includes an area 34 which contains the original addressee information as well as the necessary postage 36. In its folded condition illustrated in FIGS. 1-2, intermediate panel 14 would be the outermost panel so that it could function in the original or direct mailing of the unit.

As also shown in FIGS. 3-4, end panel 12 is of lesser length than the remaining panels. In the folded condition of unit 10, as illustrated in FIG. 21, the various panels other than end panel 12 would be folded so as to be generally of the same size and completely cover its adjacent inner panel. End panel 12, however, does not completely cover its adjacent panel 16. When the sheet is folded to its mailing condition, the entire intermediate panel 14 would be visible on the front side of unit 10 while a portion of intermediate panel 16 and the entire end panel 12 would be visible on the reverse side of the folded unit. Because portions of two different panels are visible in the folded unit, the recipient immediately knows that this is a type of mail which must be opened in order to obtain the information.

The use of a shorter end panel, such as end panel 12 is the preferred practice of the invention. If desired, however, end panel 12 may be of the same general size of the remaining panels so that it completely covers the reverse side of the folded unit.

As shown in FIG. 4, the backside of end panel 12 contains return addressee information 38 and postage 40. End panel 12 is made of two layers folded over and secured along three edges to form a reply envelope. Thus, end panel 12 is of extra or double thickness with respect to the intermediate panels. In addition to being of extra thickness to form a return envelope, end panel 12 is also provided with a flap 42 which extends across end panel 12 and which contains, for example, a suitable adhesive 44 so that upon detachment at fold line or perforated line 24 end panel 12 would conveniently function as a reply envelope.

As shown one layer of panel 12 is integral with intermediate panel 14 while flap 42 is integral with the other layer of panel 12. Preferably flap 42 is connected to panel 12 by a fold line located at perforated line 24.

In the illustrated form of the invention shown in FIGS. 3-4, the opposite end panel 22 would contain information to be inserted into the reply envelope. Such information might, for example, include stamps or blocks where the original addressee could indicate some response or might include some other form of card that could be detached at any suitable location and preferably at perforated fold line 32. If necessary, the reply form could be folded or otherwise inserted into the reply envelope formed by end panel 12.

In one practice of the invention, for example, a series of designating stamps 46 could be provided at any suitable location on the sheet, such as the front face of intermediate or original addressee panel 14. The stamps could be removed and applied to appropriate blocks 48 on the reply form of end panel 22.

Figure 6:
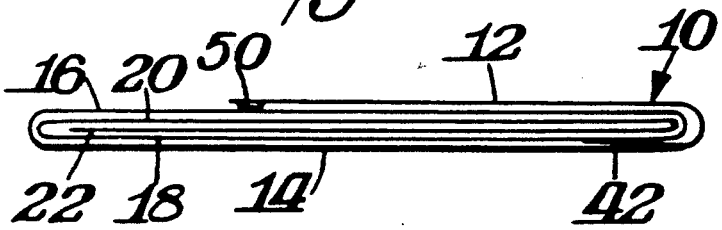
FIG. 6 is a side elevational view of the unit shown in FIGS. 1–5 in its folded condition.

In order to dispose the sheet in its folded mailing condition it is necessary to fold the various panels atop each other. A particularly advantageous manner of folding the panels would be to fold end panel 22 at its fold line 32 upon end panel 20 when viewed from FIG. 4. The composite would then be folded at fold line 30 upon intermediate panel 18 and the resulting composite would be folded at fold line 28 upon intermediate panel 16. Next the folding would be at fold line 26. Prior to the complete folding, however, flap 42 would be bent into contact with intermediate panel 14 and then the folded composite would be folded at fold line 26 over flap 42. End panel 12 would then be folded over the composite partially covering panel 16. The folded unit would then be secured in any suitable manner, such as by spot adhesive 50 as shown in FIGS. 2 and 6. When folded in this manner, the original addressee information 34 and postage 36 would be visible while the return addressee information 38 and postage 40 would be concealed.

A further advantageous feature of this invention is the utilization of personalized information along spaced transverse areas of the sheet. Such personalized information would be unique to the original addressee and would include, for example, the name and address or other personal information of the original addressee. The personalized information would appear, for example, along spaced transverse areas such as areas 52,54 where the information could serve as an indication of the name and address of the original addressee and of the return addressor, which of course, would be the same. It is not necessary, however, that each strip of personalized information be the same as each other. A salutation or other personalized variable information could be included in the body. The use of such personalized information is possible by known techniques.

When an original addressee would receive the mailing unit 10 the original addressee would realize that the unit must be opened by, for example, the fact that the rear side of the mailing unit would have portions of an interior panel, namely panel 16 visible. The original addressee would then unfold the unit in an unrolling manner so that the unfolded sheet then assumes the condition shown in FIGS. 3 and 4 with respect to each side thereof. The unfolded sheet would then convey the message or information intended by the sender and the original addressee could readily respond by detaching the reply envelope formed by panel 12 and inserting in the envelope a reply form or other information provided on the sheet.

Figure 7:
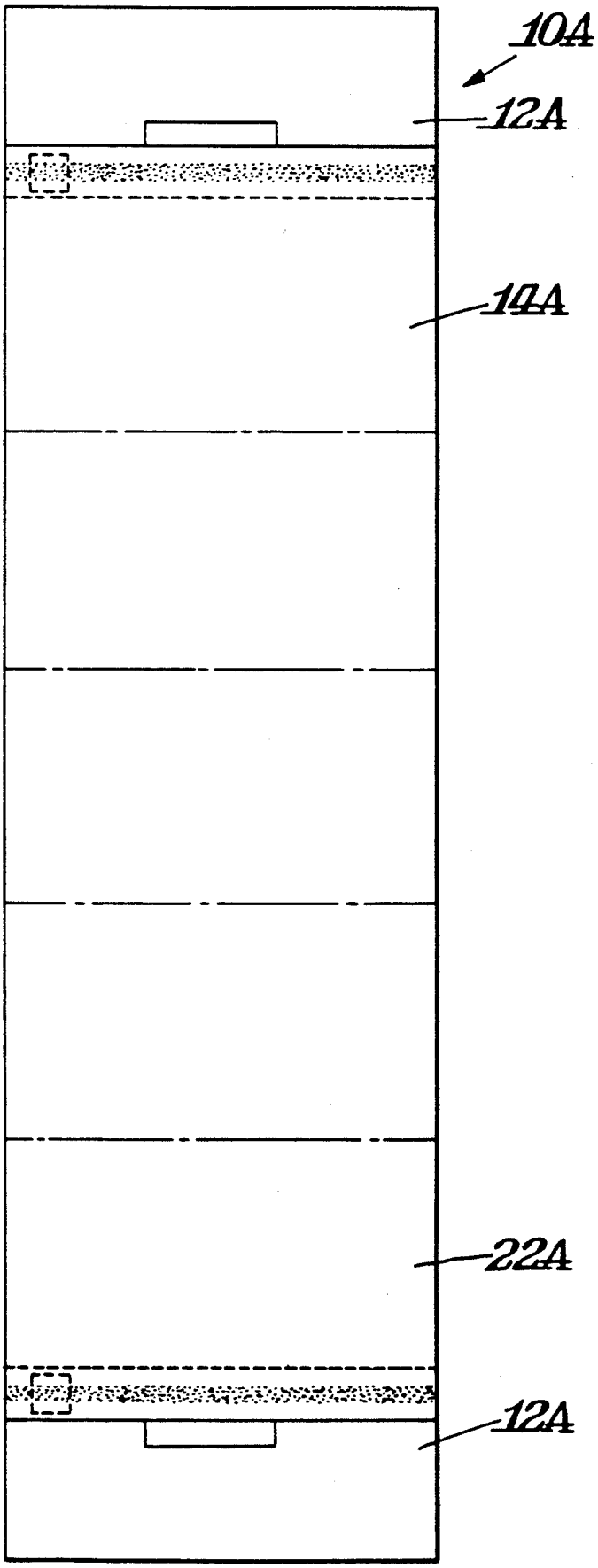
FIG. 7 is a top plan view of a modified form of mailing unit wherein a reply envelope is provided at each end thereof.
Figure 8:
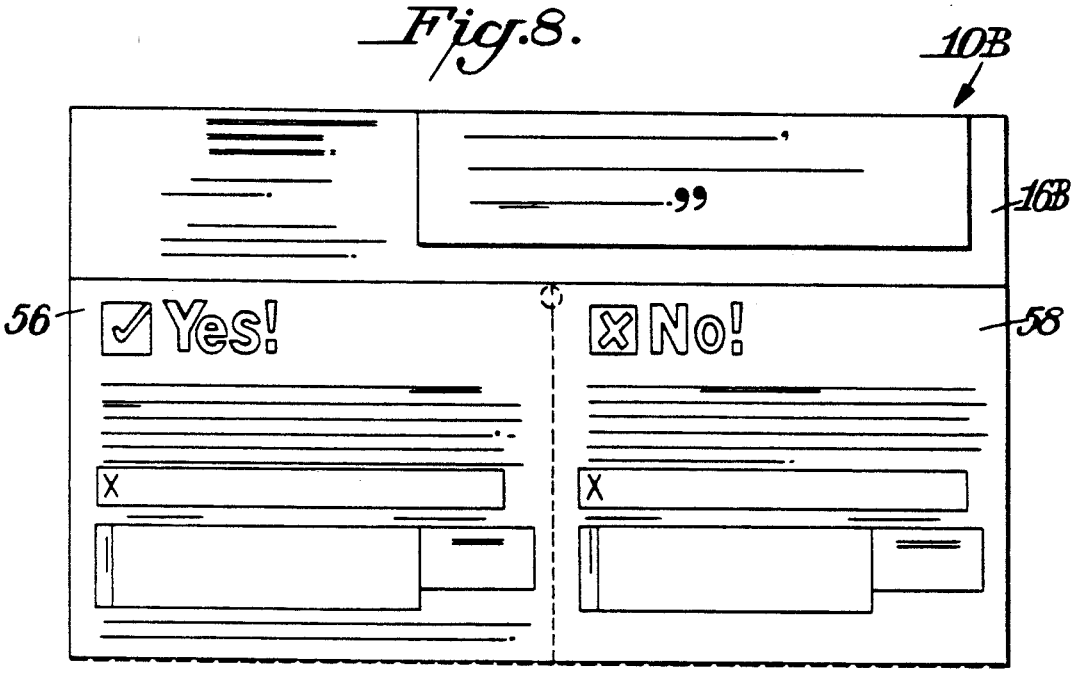
FIG. 8 is a plan view of a mailing unit in its folded condition in accordance with a further embodiment which includes reply postcards.
Figure 9:
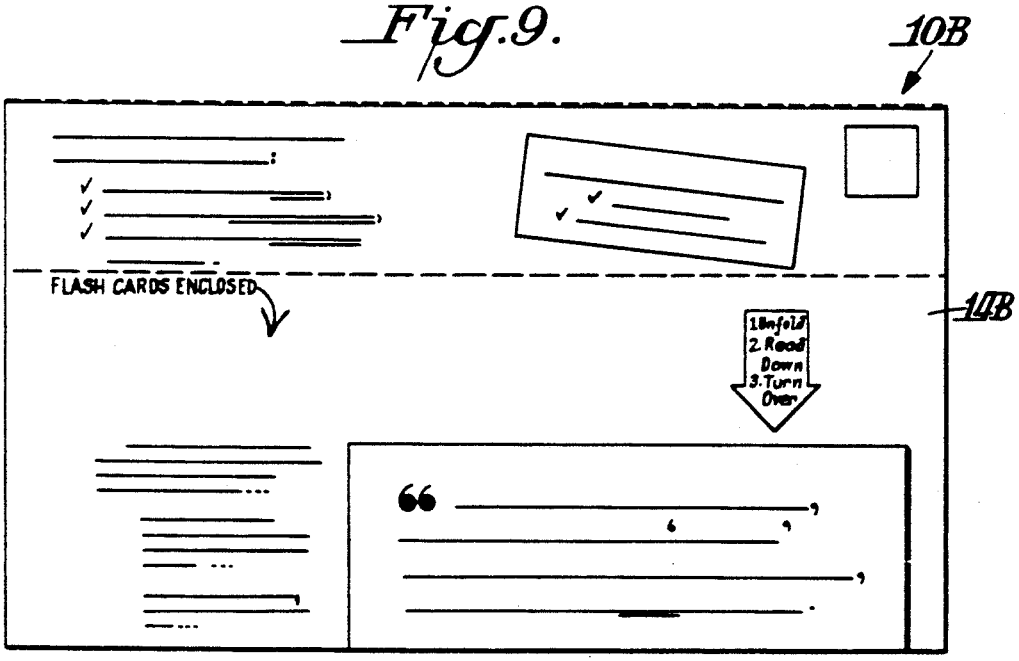
FIG. 9 is a plan view showing the reverse side of the folded unit shown in FIG. 8.
Figure 10:
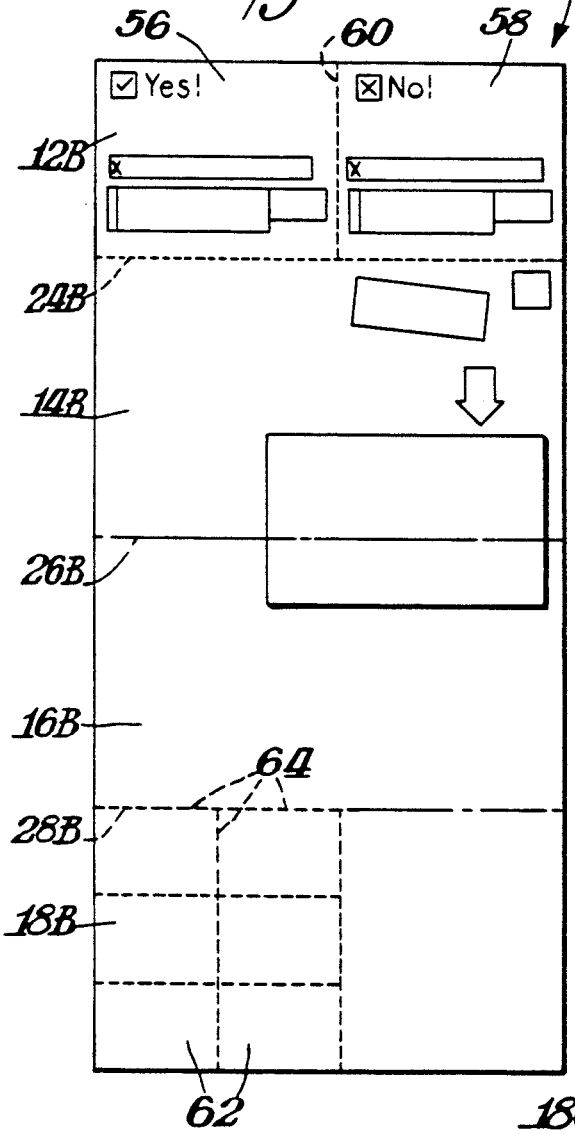
FIG. 10 is a plan view showing one face of the unit of FIGS. 8–9 in its unfolded condition.

FIG. 7 illustrates a variation of the invention wherein the unit 10A is illustrated as having an end panel 12A at each end thereof in the form of a reply envelope. This practice could be useful where multiple replies are desired for different purposes. For example, the unit might convey information soliciting a subscription to a magazine and/or some other type of response which is intended to be directed to a different location than the magazine subscription. In such case, the original addressee could make both responses by the use of both reply envelopes from panels 12A,12A.

FIGS. 8-11 illustrate a further mailing unit 10B. As shown therein, the end panel 12B is in the form of a reply postcard while a reply envelope (not shown) would be the opposite end panel. The reply postcard could in turn be divided into two sections, such as sections 56,58 which would indicate a yes or no reply as would the appropriate to the original addressee. As with the prior embodiments, the mailing unit 10B would also include a number of panels including an intermediate panel 14B containing the original addressee information on the side opposite that shown in FIG. 10 as well as adjacent panels 16B and 18B with fold lines 24B, 26B and 28B joining the panels to each other. Fold line 24B would be weakened such as being perforated to permit the ready detachment of the rely card formed by panel 12B. A perforation line 60 could also be provided to permit the individual reply cards 56,68 to be separated from each other. In addition, perforation lines 64 could be provided at any other suitable locations on the unit to permit a segmenting of portions 62 of the sheet, such as the use of stickers to be applied to the reply cards. In the case where envelopes are used stickers or other reply forms could be detached for insertion into the enveloped. Thus portions 62 represent segments that could be removed and used as part of reply information such as being inserted in an envelope or adhered to a reply postcard.

Where the invention is practiced by the use of a reply postcard, the sheet of panels must be of sufficient thickness to meet postal regulations.

Figure 12:
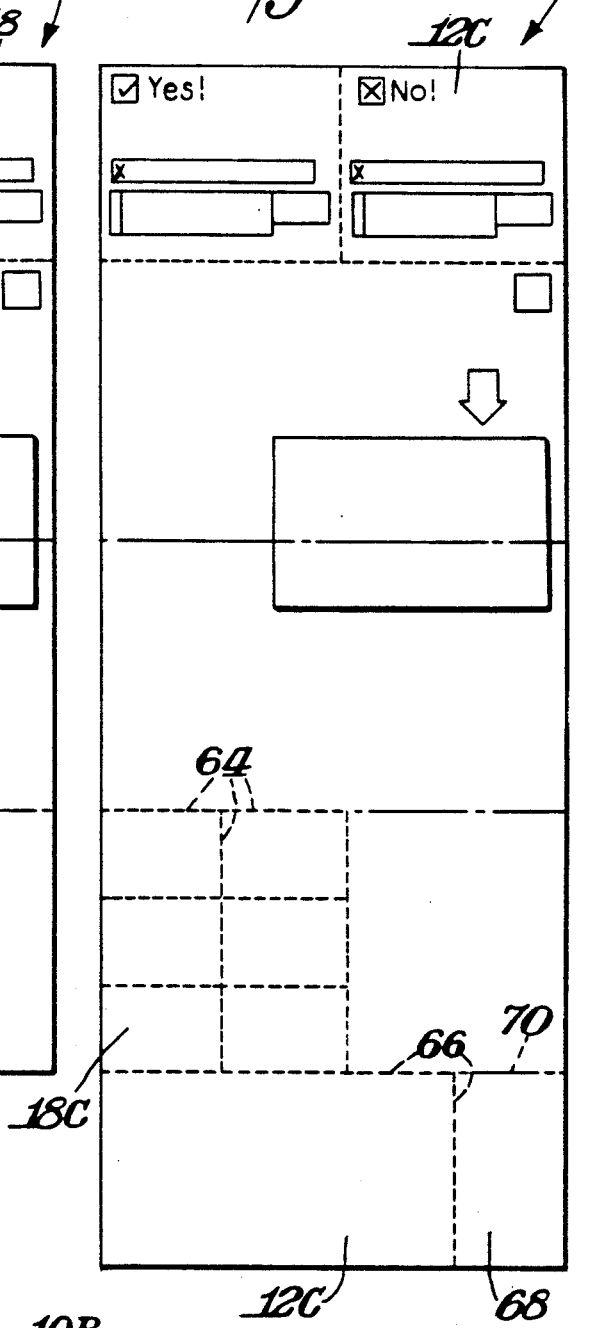
FIG. 12 is a view similar to FIG. 10 shown yet another mailing unit wherein a reply postcard is provided at each end thereof.
Figure 11:
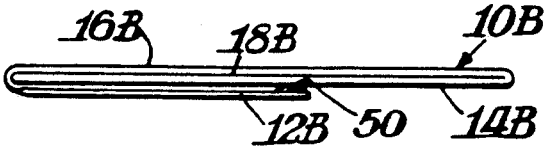
FIG. 11 is an end elevational view of the mailing unit shown in FIGS. 8–10.

FIG. 12 illustrates a modification of mailer 10C similar to mailing unit 10B except that a reply card 12C is provided at opposite ends of the sheet. A reply envelope would be detachably secured beyond at least one of the ends, although not illustrated. The reply card could include a segmented card similar to a panel 12B wherein each segment is provided with return address information and postage or could include a single reply card having perforation liens 66,66 which would leave a stub section 68 joined by its unperforated fold line 70 to intermediate section 18C. The detached reply card formed by perforation line 66,66 would contain the necessary return addressee and postage.

Figure 13:
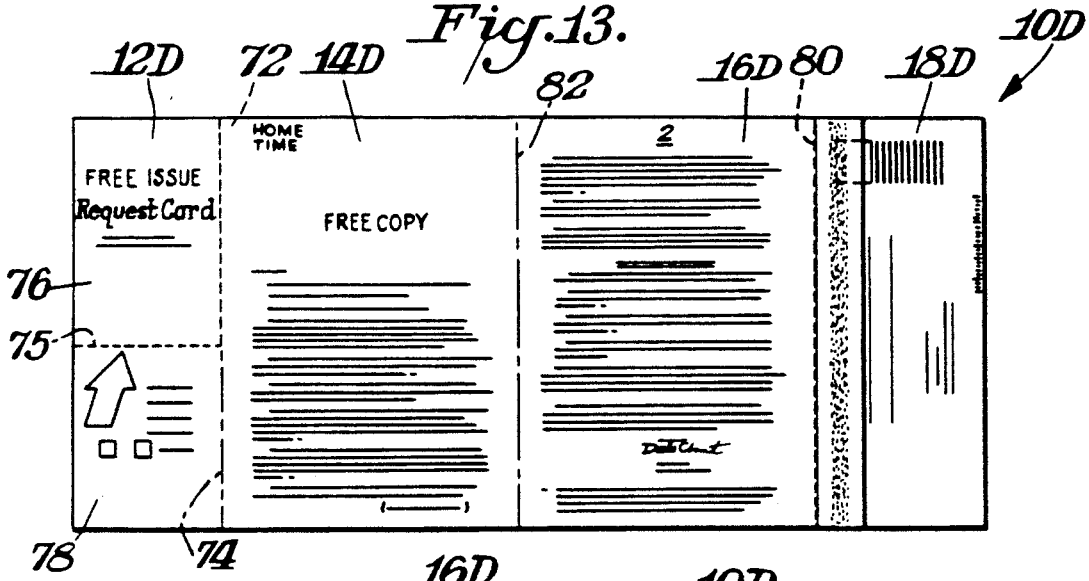
FIG. 13 is a plan view shown one face of an unfolded mailing unit in accordance with yet another embodiment of this invention utilizing a reply envelope.
Figure 14:
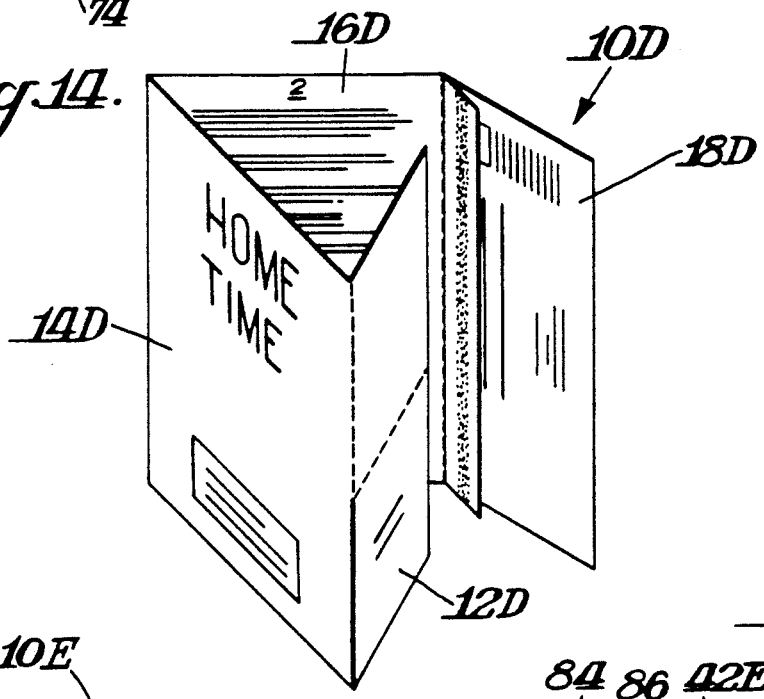
FIG. 14 is a perspective view showing the mailing unit of FIG. 13 while it is being folded to its mailing condition.

FIGS. 13-14 illustrates a further variation of this invention wherein a mailing unit 10D is provided in the form of an end panel 12D attached to intermediate panel 14D which in turn is attached to intermediate panel 16D which in turn is attached to end panel 18D. In this variation, panel 18D is in the form of a reply envelope. A partial perforation line 72 and partial unperforated fold line 74 join panel 12D with adjacent panel 14D. Panel 12 D in turn may be segmented into a detachable portion 76 and a permanent stub portion 78 at perforation line 75. The detachable portion 76 could be used for insertion into the envelope formed in panel 18D or the detachable portion 76 may itself comprise a reply postcard.

The mailing unit 10D would be placed in its folded mailing condition by folding the end panels inwardly along fold lines 80 and combined fold line 72,74 to place the end panels against the intermediate panels. The composite would then be folded along center fold line 82 to result in a folded unit having a gate fold of the same size as panel 14D having the exposed original addressee information. The folded unit could be fastened closed by adhesive, staples, etc. Mailing unit 10D is particularly desirable for advertising magazines wherein the folded unit would be about the same size as a magazine, such as 8½ by 11 inches.

Figure 15:
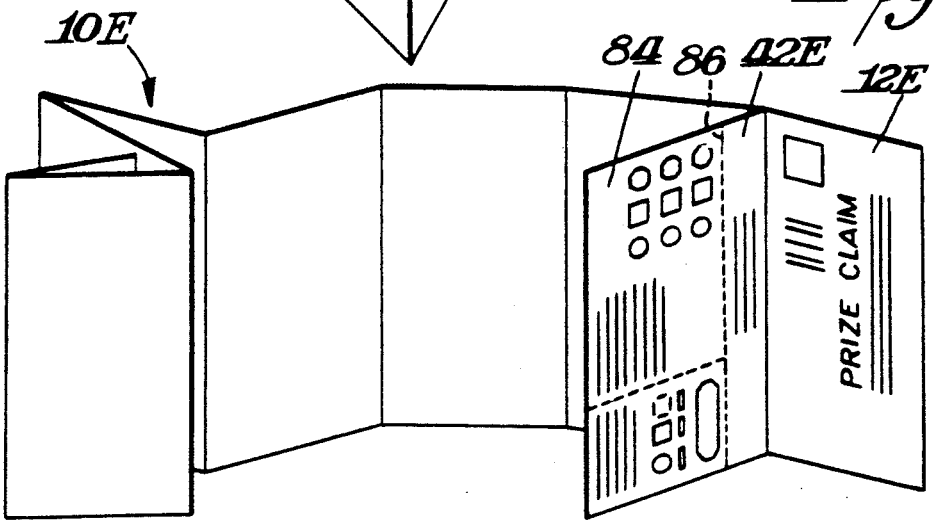
FIG. 15 is a perspective view of a mailing unit in accordance with yet another embodiment of this invention.

FIG. 15 illustrates a further variation for the invention wherein the mailing unit 10E includes an end panel 12E intended to function as a return envelope. The mailing flap 42E, however, has an extension 84 integral therewith and joined by a perforated line 86. Such form of envelope is conventionally known as a bang tail wherein the perforated flap 84 would be removed and inserted in the envelope and the stub 42E would be used for sealing the envelope.

It is to be understood that the invention may be practiced by forming the individual panels of various sizes. In all practices of the invention, however, the panel having the original addressee information and postage would form the largest panel, although other panels could be as large, such as in the embodiment of FIG. 14. Preferably, however, successive panels are made slightly smaller than the original addressee panel so that a compact folding could result. In the preferred practice of the invention, the exposed return addressee panel would be made significantly smaller so that an intermediate panel would be readily visible from the backside of the folded unit to immediately alert the original addressee that the unit must be opened.

The invention may also be practiced by omitting a separate flap for sealing the envelope, such as flap 42 and instead providing a portion of the panel 12 which is connected to panel 14 with an adhesive transverse margin and its own fold line so that upon detachment, the adhesive transverse margin could be folded over and used to seal the envelope. The provision of a separate folding flap which constitutes a third layer of thickness is preferred, however, since the existence of that flap makes it immediately obvious to the recipient that the mailing unit includes an envelope. This is particularly desired to attract the attention of the recipient before the recipient might tend to discard the mailing unit without actually reviewing the information. Accordingly, any manner of attracting the recipient's attention, such as the separate envelope flap, the extra thickness reply card, the shortened end flap and the personalized message transverse bar is useful in attracting the attention of the recipient s that the information being sent will be considered and a response will be made.

What is claimed is:

1. A direct and return mailing unit comprising a unitary sheet having at least three panels in the form of two end panels and at least one intermediate panel, a fold line connecting each of said panels to its adjacent panel, at least one of said end panels being of multi-layer extra thickness with respect to said intermediate panels, said multi-layers being joined at three edges to form an envelope, said sheet and said panels having a front side and a back side, one of said intermediate panels being an original addressee panel having original addressee information and postage on said front side, said extra thickness end panel having return addressee information and postage on one of said sides, said fold line for said extra thickness panel being a perforation line to facilitate detachment of said extra thickness panel, said panels being folded against each other to provide a folded assembly of the size of said original addressee panel with said original addressee information visible and said return addressee information concealed, said folded assembly having exposed outer sides, said extra thickness panel being of lesser length than the length of each of said remaining panels, said extra thickness panel being on one of said exposed outer sides of said folded assembly, a portion of another of said panels adjacent to said extra thickness panel while in said folded assembly extending beyond said extra thickness panel, said extra thickness panel and said portion of said panel adjacent to said extra thickness panel being one of said exposed outer sides of said folded assembly and said original addressee panel being the other of said exposed outer sides, and fastening means holding said panels in said folded assembly.

2. The unit of claim 1 wherein a plurality of spaced transverse areas containing personalized information are on said front side including being on said original addressee panel.

3. The unit of claim 2 wherein said extra thickness panel has an integral sealing flap with adhesive thereon.

4. The unit of claim 3 wherein said sealing flap is an extension of one of said layers connected to its adjacent intermediate panel.

5. The unit of claim 3 wherein said sealing flap comprises a further layer having an unconnected edge.

6. The unit of claim 5 wherein a weakened line extends transversely across said sealing flap to divide said flap into a transverse stub section integral with one of said layers and a reply section integral with said stub section, said adhesive being on said stub section whereby said stub section may close said envelope, and reply information being on said reply section whereby said reply section may be detached and inserted into said envelope.

7. The unit of claim 3 wherein each of said end panels is of extra thickness and comprises an envelope having return addressee information and postage with its fold line being a perforation line to facilitate detachment thereof.

8. The unit of claim 3 wherein the other of said end panels contains reply form information with return addressee information and postage, and said fold line of said other of said end panels being a perforation line.

9. The unit of claim 3 wherein weakened lines are provided on said panels other than said extra thickness panel to facilitate detachment of sections of said panels for use as reply information to be inserted into said envelope.

10. The unit of claim 2 wherein said original addressee panel is the largest of said panels.

11. The unit of claim 1 wherein a plurality of spaced transverse areas containing personalized in formation are on said front face including being on said original address panel.

12. The unit of claim 1 wherein said return addressee information and postage are on said back side of said sheet.

13. A direct and return mailing unit comprising a unitary sheet having two end panels and two intermediate panels between said end panels, said intermediate panels being connected by a non-weakened fold line, said non-weakened fold line being the centerline of said unit, said intermediate panels being of the same size as each other, a weakened fold line connecting each of said end panels to its adjacent intermediate panel, each of said end panels being of substantially lesser length than the length of each of said intermediate panels, at least one of said end panels being of multi-layer extra thickness with the layers spaced from each other to form at least one envelope having joined edges and a sealing flap, the other of said end panels being divided into two section by a weakened line which extends to its weakened fold line in a perpendicular direction whereby each of said sections may be detached from said unit independently of each other, each of said end panels being folded against its adjacent intermediate panel, said end panels contacting each other when said intermediate panels are folded at said unweakened fold line, and one of said intermediate panels having exposed original addressee information and postage.

* * * * *